US010618615B1

(12) United States Patent
Wiedemeier et al.

(10) Patent No.: US 10,618,615 B1
(45) Date of Patent: Apr. 14, 2020

(54) DAMPENED CAPTURE MECHANISM

(71) Applicant: The United States of America as represented by the Secretary of the Navy, San Diego, CA (US)

(72) Inventors: Brandon J. Wiedemeier, San Diego, CA (US); Nathan T. Miller, San Diego, CA (US)

(73) Assignee: United States of America as represented by Secretary of the Navy, Washington, DC (US)

( * ) Notice: Subject to any disclaimer, the term of this patent is extended or adjusted under 35 U.S.C. 154(b) by 73 days.

(21) Appl. No.: 16/148,018

(22) Filed: Oct. 1, 2018

(51) Int. Cl.
*B63G 8/00* (2006.01)
*B63G 9/02* (2006.01)
*B63C 1/12* (2006.01)

(52) U.S. Cl.
CPC ..... *B63G 9/02* (2013.01); *B63C 1/12* (2013.01); *B63B 2732/00* (2013.01); *B63G 2008/008* (2013.01)

(58) Field of Classification Search
CPC .... B63G 2008/008; B63G 9/02; B63B 43/18; B63B 59/02; B64G 1/646; E02B 3/26
See application file for complete search history.

(56) References Cited

U.S. PATENT DOCUMENTS 3,063,399 A * 11/1962 Schuyler ..... B63B 59/02 114/219
7,699,015 B1 * 4/2010 Said ..... B63B 21/56 114/249
9,453,317 B2 * 9/2016 Breedt ..... E02B 3/26
10,351,212 B2 * 7/2019 Jourdan ..... B63B 27/36

* cited by examiner

*Primary Examiner* — Andrew Polay
(74) *Attorney, Agent, or Firm* — Naval Information Warfare Center, Pacific; Kyle Eppele; Young Fei

(57) ABSTRACT

A device for capturing underwater vehicles. The device comprises a cap member connected to a first rib member and a first plate member connected to the first rib member. The device further comprises a bell member with a first bell hole formed therethrough. The first bell member also has a first bell slot formed therethrough. A damper and a shim are slidably received in the first bell slot. The first rib member is slidably received in the first bell hole.

20 Claims, 15 Drawing Sheets

DAMPENED CAPTURE MECHANISM

FEDERALLY SPONSORED RESEARCH AND DEVELOPMENT

The Dampened Capture Mechanism is assigned to the United States Government and is available for licensing and commercial purposes. Licensing and technical inquiries may be directed to the Office of Research and Technical Applications, Space and Naval Warfare Systems Center Pacific (Code 72120), San Diego, Calif., 92152 via telephone at (619) 553-2778 or email at ssc_pac_t2@navy.mil. Reference Navy Case 107382.

BACKGROUND OF THE INVENTION

1. Field of the Invention

The present invention relates to devices for capturing vehicles, and particularly to a conical device for capturing unmanned underwater vehicles traveling at speed.

2. Description of the Related Art

Prior art unmanned underwater vehicle capture mechanisms have come in many forms. These include flexible arm arrays, ropes, netting, sheets, and solid cones. These prior art devices have been developed to capture vehicles of differing sizing, and have achieved varying degrees of success. For larger or more delicate vehicles, capture mechanisms should be compliant. Prior art non-compliant rigid structures do not guarantee successful, damage-free capture. When the vehicle hits the capture structure, there should be some means of dissipating the vehicle's kinetic energy so that the impact force is lessened. Capture mechanisms also should be rigid enough in order to hold the vehicle securely and precisely. Thus, prior art net or rope-based mechanisms are not sufficient for many applications. The vehicle should also be able to escape the capture mechanism under its own power. Prior art designs may not allow the vehicle to escape without external help. Thus, prior art designs with elements which could snag or bind the vehicle in place once the vehicle has been captured are ruled out.

SUMMARY OF THE INVENTION

The present invention is a device for capturing underwater vehicles. The device comprises a cap member connected to a first rib member and a first plate member connected to the first rib member. The device further comprises a bell member with a first bell hole formed therethrough. The first bell member also has a first bell slot formed therethrough. A damper and a shim are slidably received in the first bell slot. The first rib member is slidably received in the first bell hole.

BRIEF DESCRIPTION OF THE DRAWINGS

Throughout the several views, like elements are referenced using like elements. The elements in the figures are not drawn to scale, and some dimensions may be exaggerated for clarity.

DETAILED DESCRIPTION OF THE INVENTION

While this invention may be embodied in different forms, the drawings and this section describe in detail specific embodiments of the invention with the understanding that the present disclosure is to be considered merely a preferred embodiment of the invention, and is not intended to limit the invention in any way.

Figure 1:
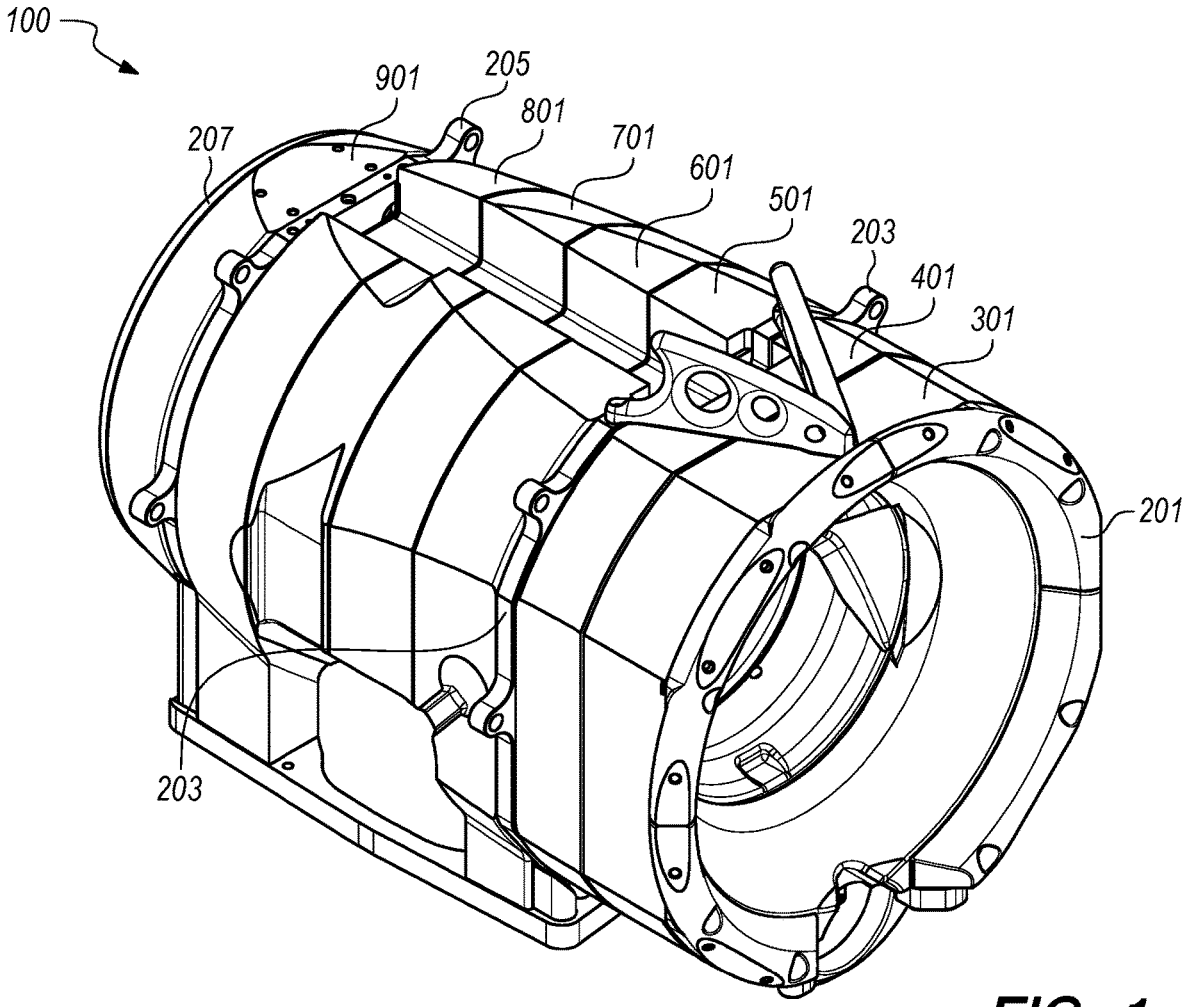
FIG. 1 shows a front perspective view of an embodiment of the present invention.

The present invention is a device for capturing underwater vehicles 100. FIG. 1. shows a frontal perspective view of an embodiment of the invention. The device 100 comprises an aluminum cap member 201 at the front. Additionally, the device 100 comprises a series of bell members with a gap between each of them. In this embodiment, there are a total of seven bell members: a first bell member 301, a second bell member 401, a third bell member 501, a fourth bell member 601, a fifth bell member 701, a sixth bell member 801, and a seventh bell member 901. There is an aluminum first plate member 203 between the second bell member 401 and the third bell member 501. There is an aluminum second plate member 205 between the sixth bell member 801 and the seventh bell member 901. At the back of the device 100, there is an aluminum tail member 207.

Figure 2:
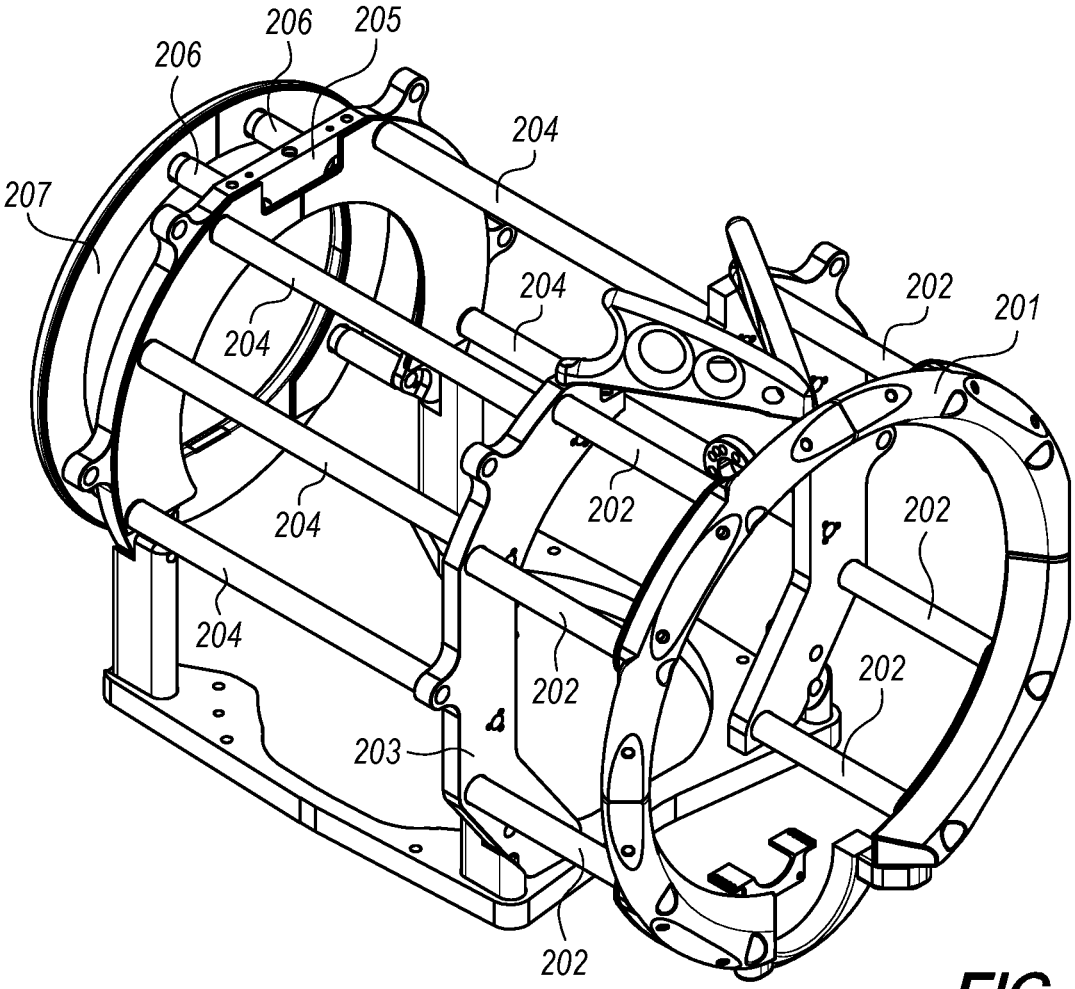
FIG. 2 shows a front perspective view of selected elements of an embodiment of the present invention.

FIG. 2 shows the components of the device 100 which serve as an underlying structural frame which serves as a guide for the movement of the bell members. In this embodiment, a total of eight first rib members 202 are attached to the cap member 201 and first plate member 203. Similarly, a total of six second rib members 204 connect the first plate member 203 with the second plate member 205. Four third rib members 206 connect the second plate member 205 with the tail member 207.

Figure 3:
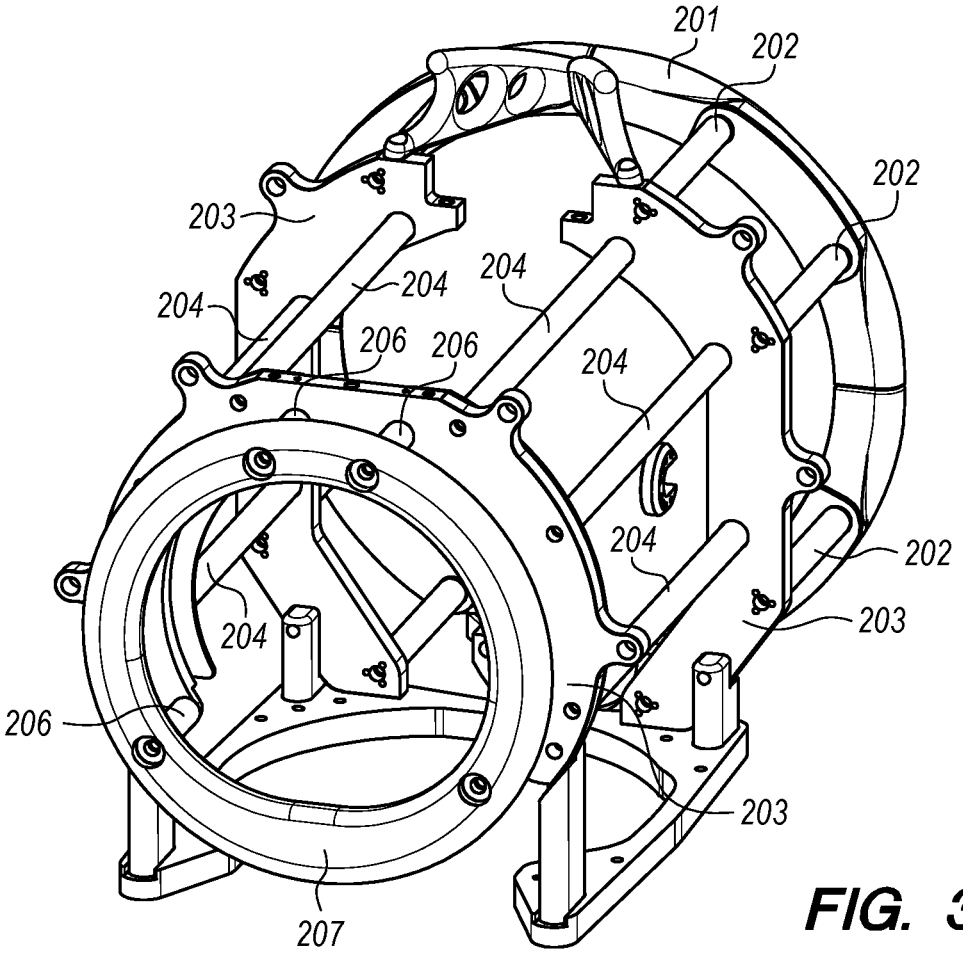
FIG. 3 shows a rear perspective view of selected elements of an embodiment of the present invention.

FIG. 3 shows the underlying structural frame of the device 100 from a rear perspective view.

Figure 4A:
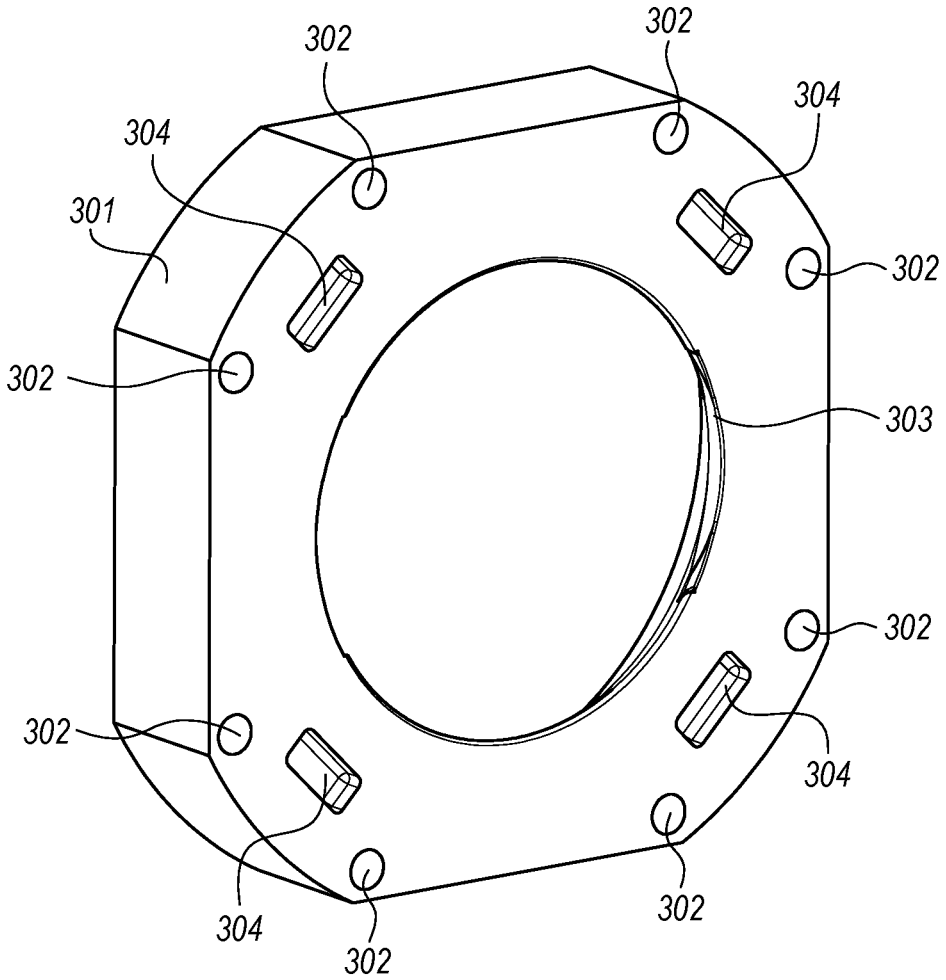
FIG. 4A shows a rear perspective view of selected elements of an embodiment of the present invention.

FIG. 4A shows a rear perspective view of the first bell member 301. The first bell member 301 has eight first bell holes 302 formed therethrough. The first bell member 301 also has a first receiving hole 303 formed therethrough for receiving the underwater vehicle as it docks. The first bell member 301 also has four first bell slots 304 formed thereon for receiving dampers 208 and shims 209.

Figure 4B:
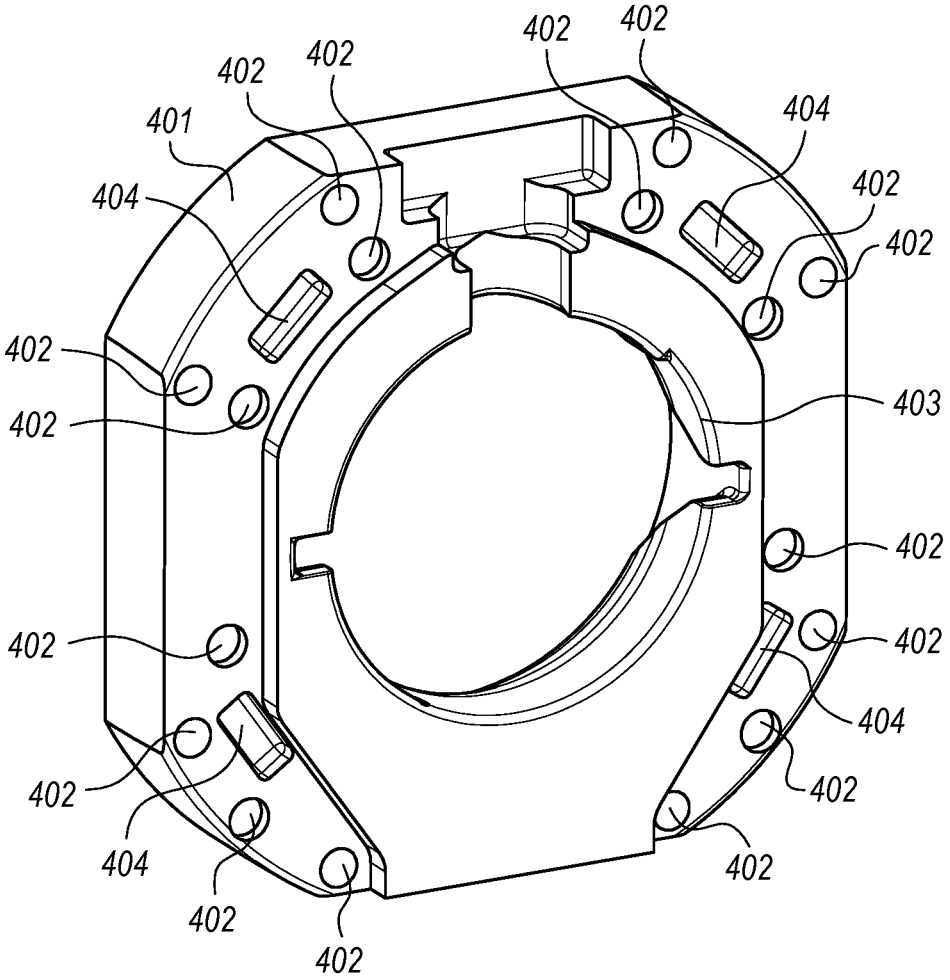
FIG. 4B shows a rear perspective view of selected elements of an embodiment of the present invention.

FIG. 4B shows a rear perspective view of the second bell member 40. The second bell member 401 has sixteen second bell holes 402 formed therethrough. The second bell member 401 also has a second receiving hole 403 formed therethrough for receiving the underwater vehicle as it docks. The second bell member 401 also has four second bell slots 404 formed thereon for receiving dampers 208 and shims 209.

Figure 5A:
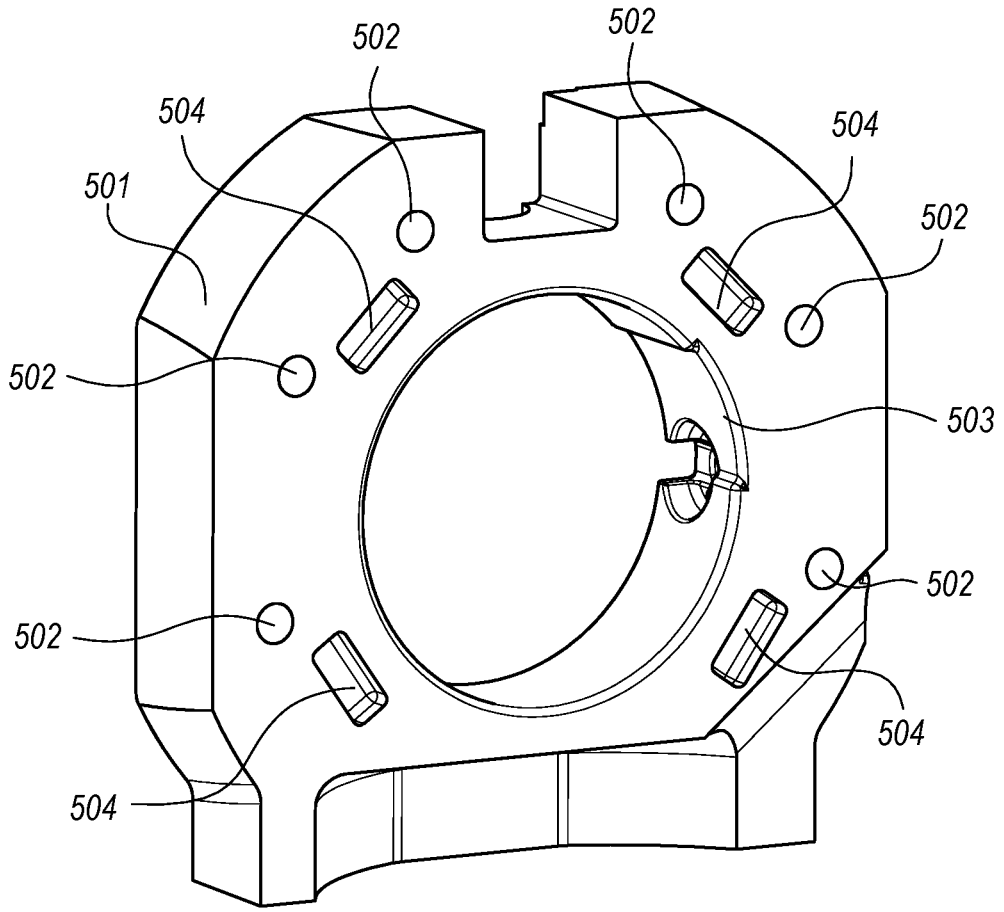
FIG. 5A shows a rear perspective view of selected elements of an embodiment of the present invention.

FIG. 5A shows a rear perspective view of the third bell member 501. The third bell member 501 has six third bell holes 502 formed therethrough. The third bell member 501 also has a third receiving hole 503 formed therethrough for receiving the underwater vehicle as it docks. The third bell member 501 also has four third bell slots 504 formed thereon for receiving dampers 208 and shims 209.

Figure 5B:
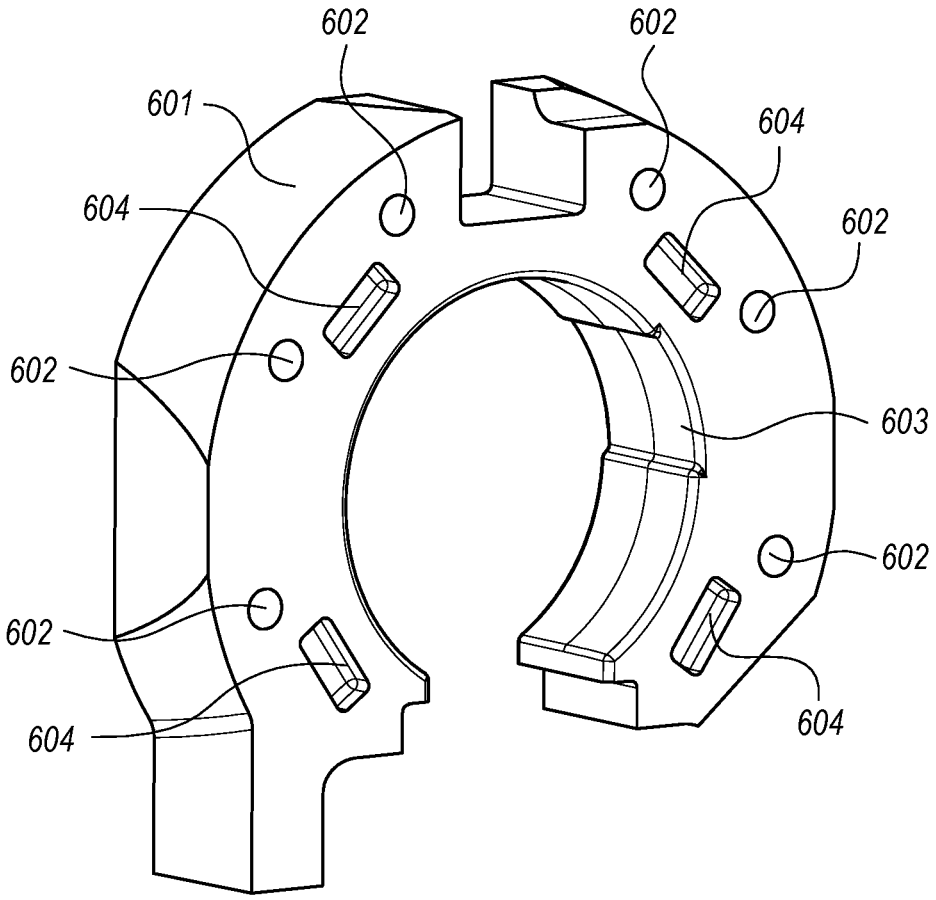
FIG. 5B shows a rear perspective view of selected elements of an embodiment of the present invention.

FIG. 5B shows a rear perspective view of the fourth bell member 601. The fourth bell member 601 has six fourth bell holes 602 formed therethrough. The fourth bell member 601 also has a fourth receiving opening 603 formed therethrough for receiving the underwater vehicle as it docks. The fourth bell member 601 also has four fourth bell slots 604 formed thereon for receiving dampers 208 and shims 209.

Figure 5C:
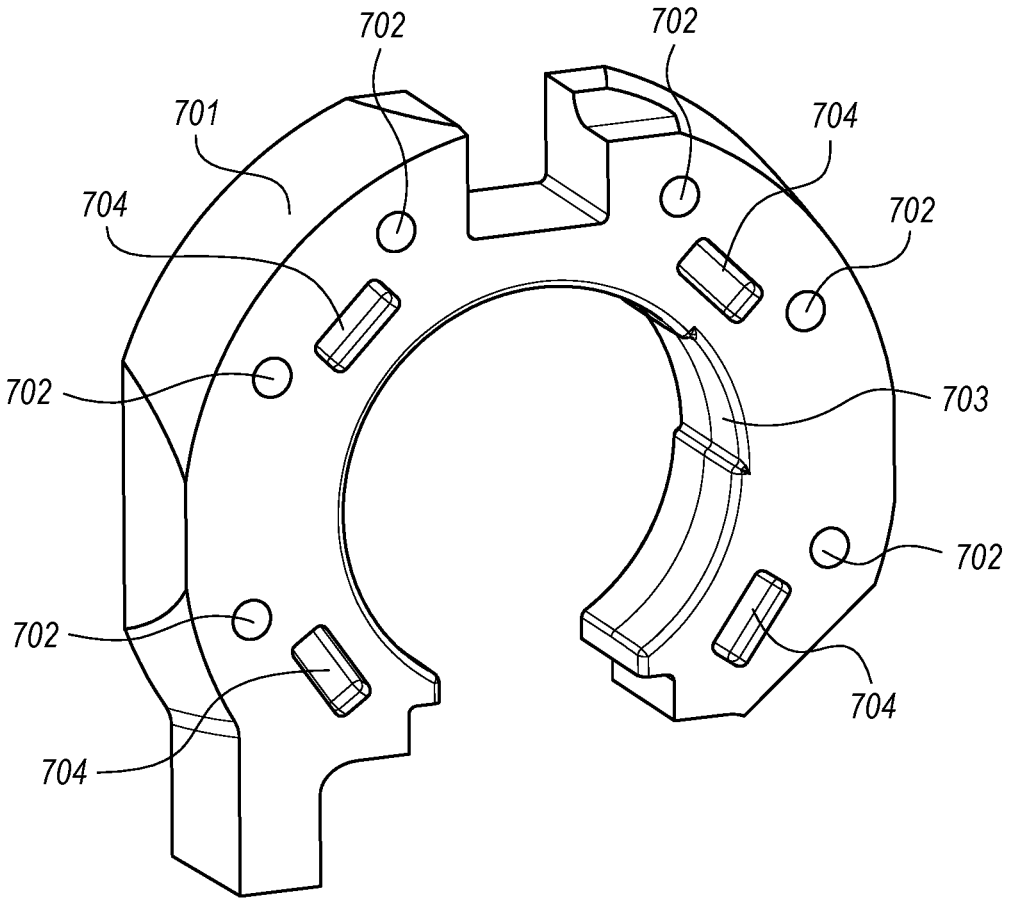
FIG. 5C shows a rear perspective view of selected elements of an embodiment of the present invention.

FIG. 5C shows a rear perspective view of the fifth bell member 701. The fifth bell member 701 has six fifth bell holes 702 formed therethrough. The fifth bell member 701 also has a fifth receiving opening 703 formed therethrough for receiving the underwater vehicle as it docks. The fifth bell member 701 also has four fifth bell slots 702 formed thereon for receiving dampers 208 and shims 209.

Figure 5D:
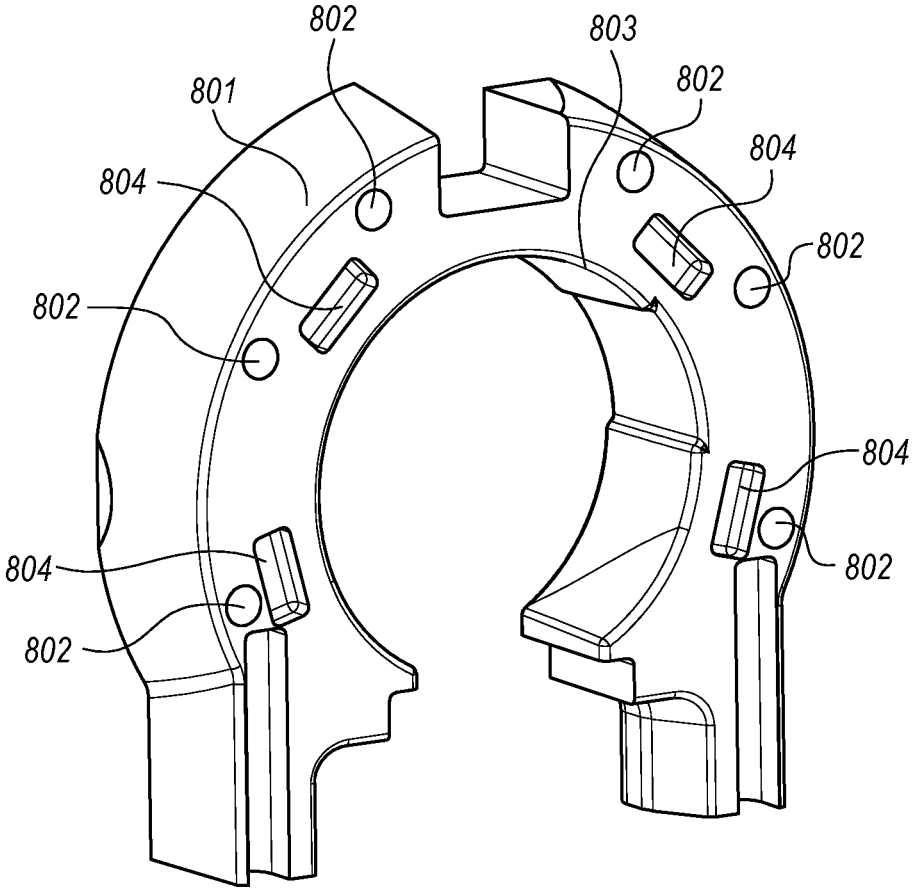
FIG. 5D shows a rear perspective view of selected elements of an embodiment of the present invention.

FIG. 5D shows a rear perspective view of the sixth bell member 801. The sixth bell member 801 has six sixth bell holes 802 formed therethrough. The sixth bell member 801 also has a sixth receiving opening 803 formed therethrough for receiving the underwater vehicle as it docks. The sixth bell member 801 also has four sixth bell slots 802 formed thereon for receiving dampers 208 and shims 209.

Figure 6:
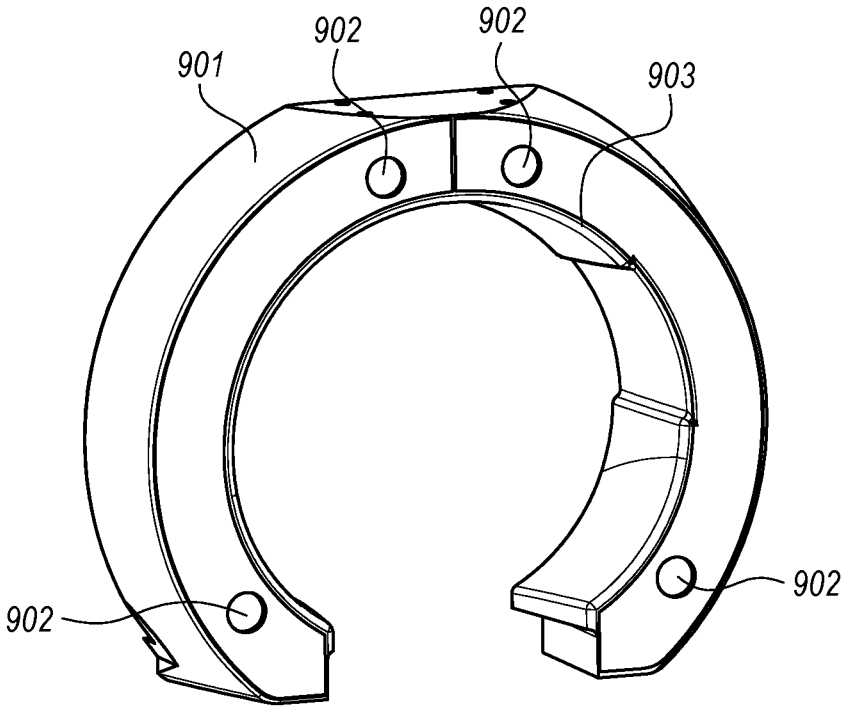
FIG. 6 shows a rear perspective view of selected elements of an embodiment of the present invention.

FIG. 6 shows a rear perspective view of the seventh bell member 901. The seventh bell member 901 has four seventh bell holes 902 formed therethrough. The seventh bell member also has a seventh receiving opening 903 formed therethrough for receiving the underwater vehicle as it docks.

Figure 7:
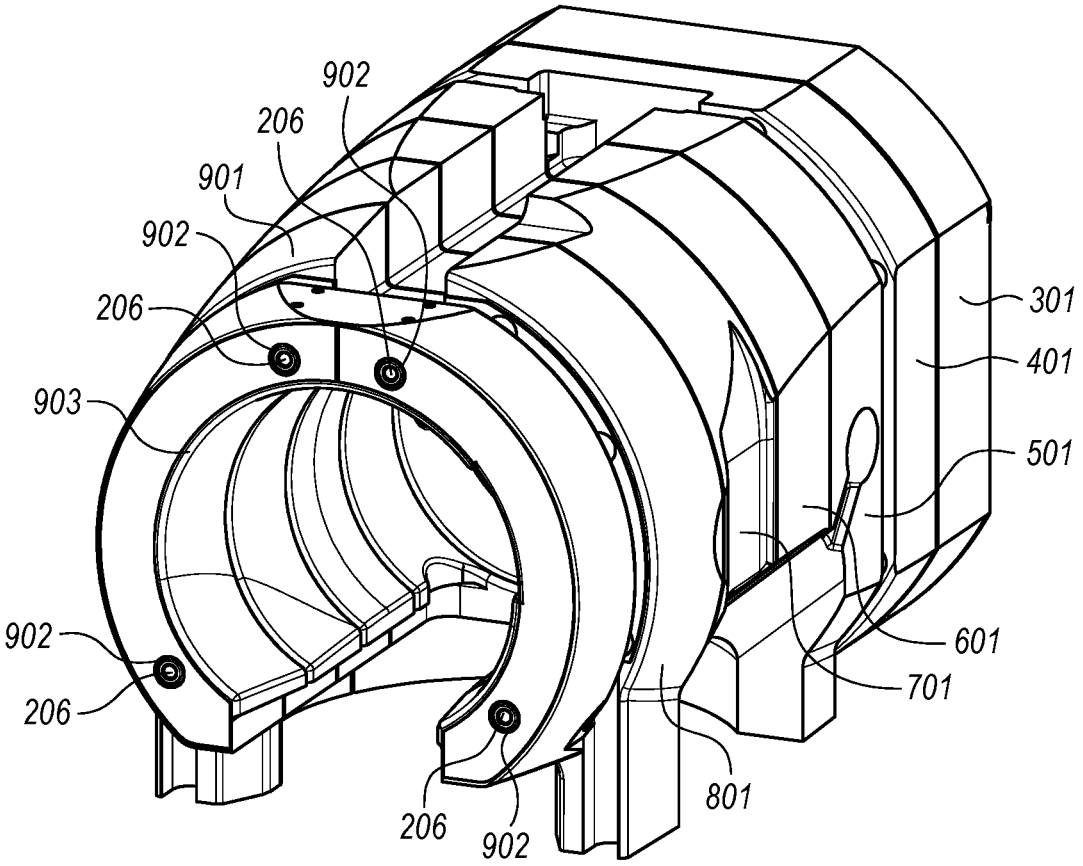
FIG. 7 shows a rear perspective view of an embodiment of the present invention.

FIG. 7 shows a rear perspective view of the first bell member 301, second bell member 401, third bell member 501, fourth bell member 601, fifth bell member 701, sixth bell member 801, and seventh bell member 902 with four third rib members 206 slidably received in the seventh bell holes 902.

Figure 8:
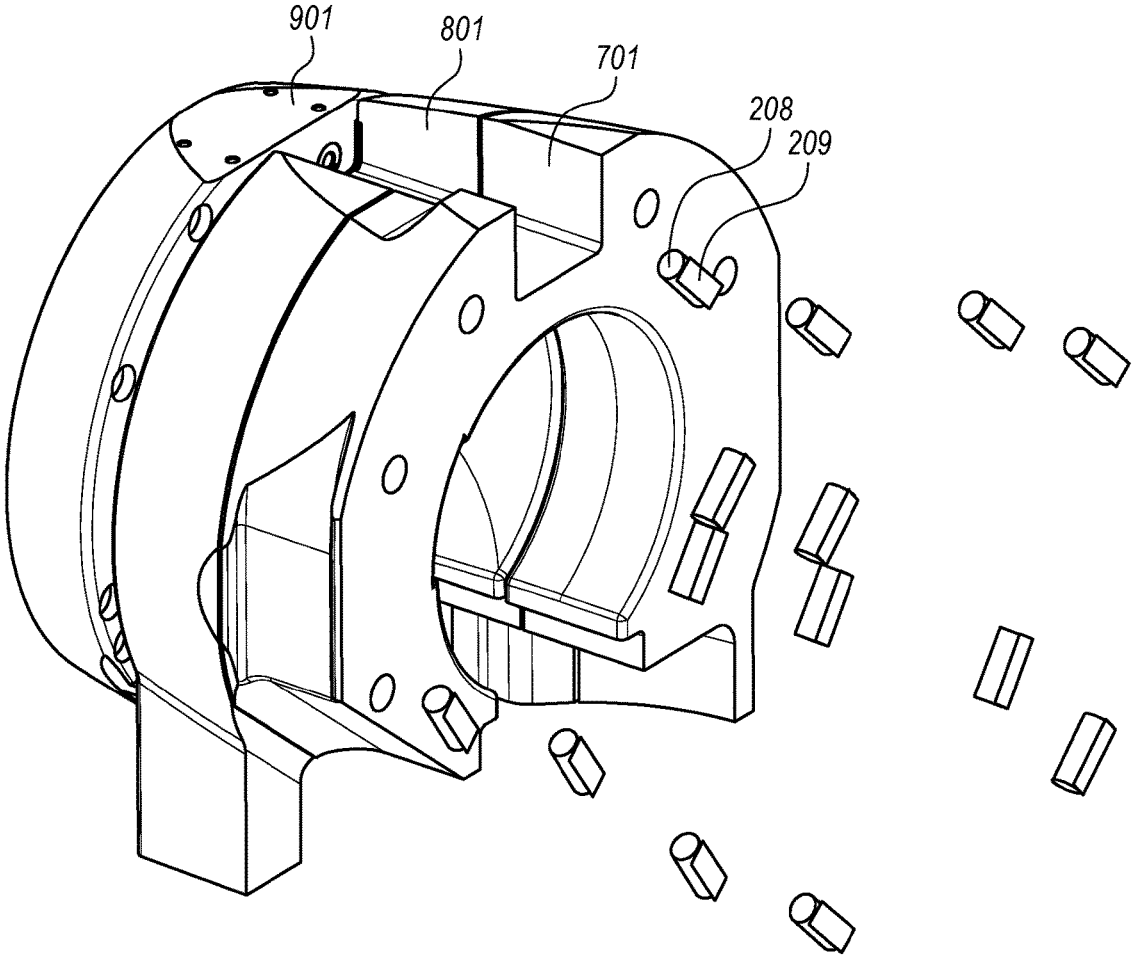
FIG. 8 shows a front perspective view of selected elements of an embodiment of the present invention.

FIG. 8 shows a plurality of dampers 208 and shims 209 as well as the fifth bell member 701, sixth bell member 801, and seventh bell member 901. The dampers 208 and shims 209 are slidably received in each bell slot, and create a gap between each of the bell members. In this embodiment, the dampers 208 are sections of O-ring cord.

Figure 9:
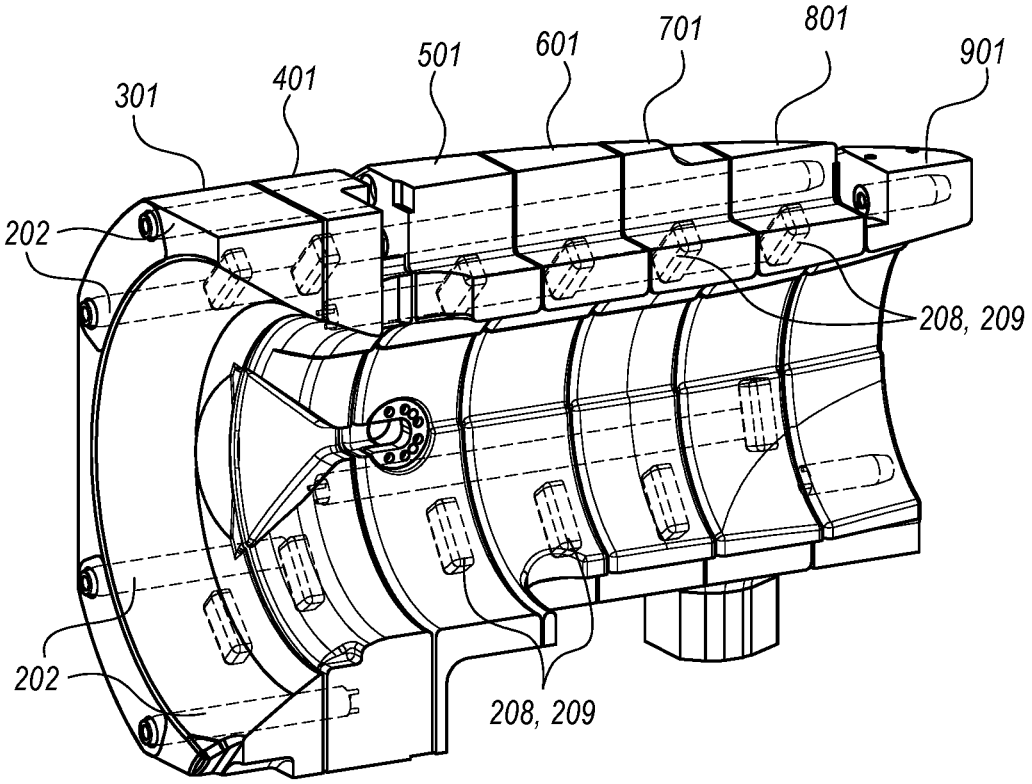
FIG. 9 shows a side sectional view of an embodiment of the present invention.

FIG. 9 is a sectional view showing how the bell members, frame, and dampers 208 and shims 209 fit together. The first rib members 202, second rib members 204, and third rib members 206 are slidably received through the bell holes of each bell member. The dampers 208 and shims 209 are slidably received in the first bell slots 304, second bell slots 404, third bell slots 504, fourth bell slots 604, fifth bell slots 704, and sixth bell slots 804. The damper 208 sits between each bell member. Each bell member is able to slide on the rib members. When the cap member 201, first bell member 301, or second bell member 401 is struck by the underwater vehicle, the dampers 208 compress, and the gap between each of bell members is lessened, squeezing out the working fluid (in this embodiment, seawater). The dampers 208, the masses of the bell members, and the gap geometry between the bell members can be tuned to increase the impulse length during the impact, therefore reducing the deceleration experienced by the vehicle and the peak forces experienced at both the underwater vehicle and device 100.

Figure 10:
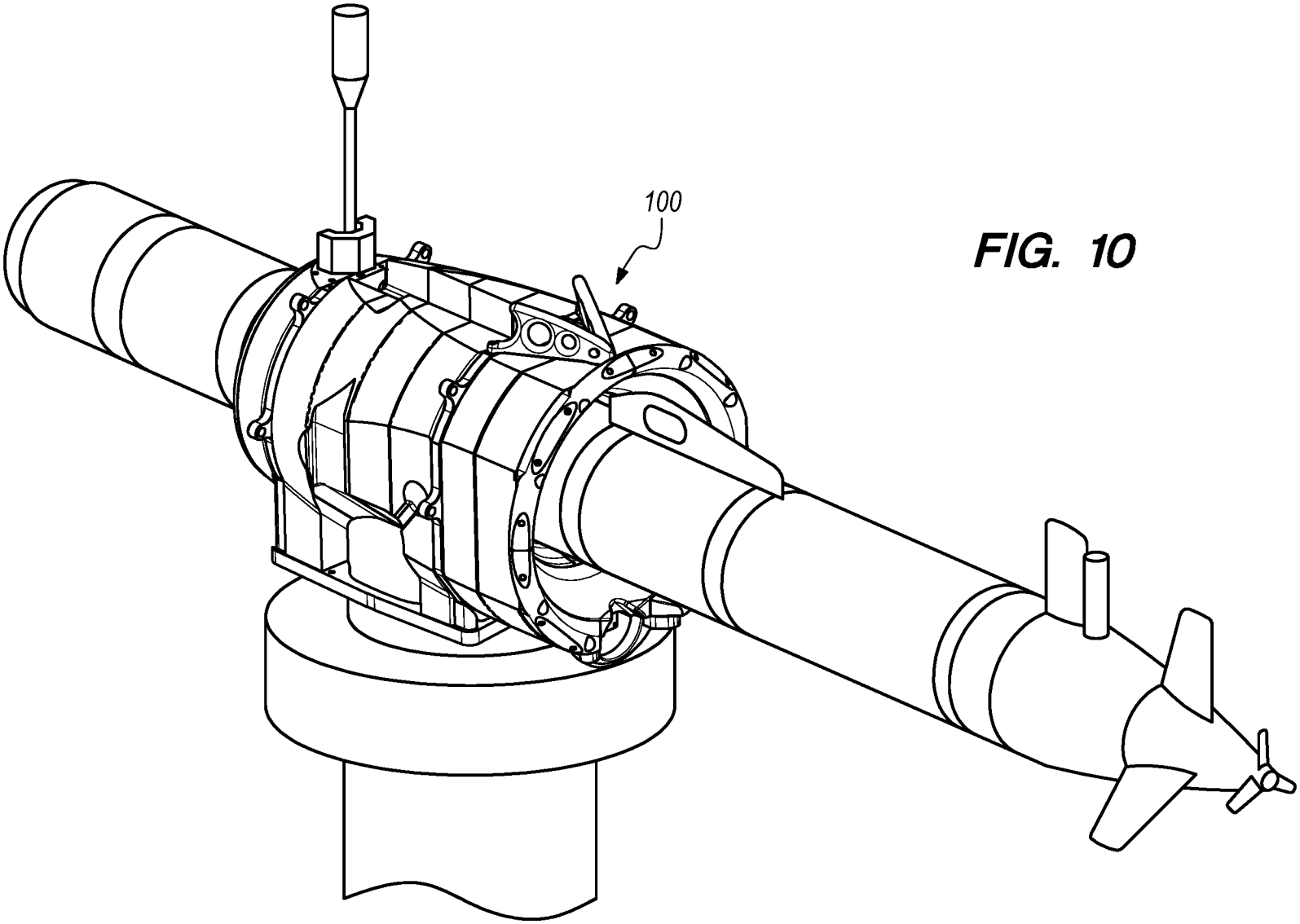
FIG. 10 is a perspective view showing an underwater vehicle docking with an embodiment of the present invention.
Figure 11:
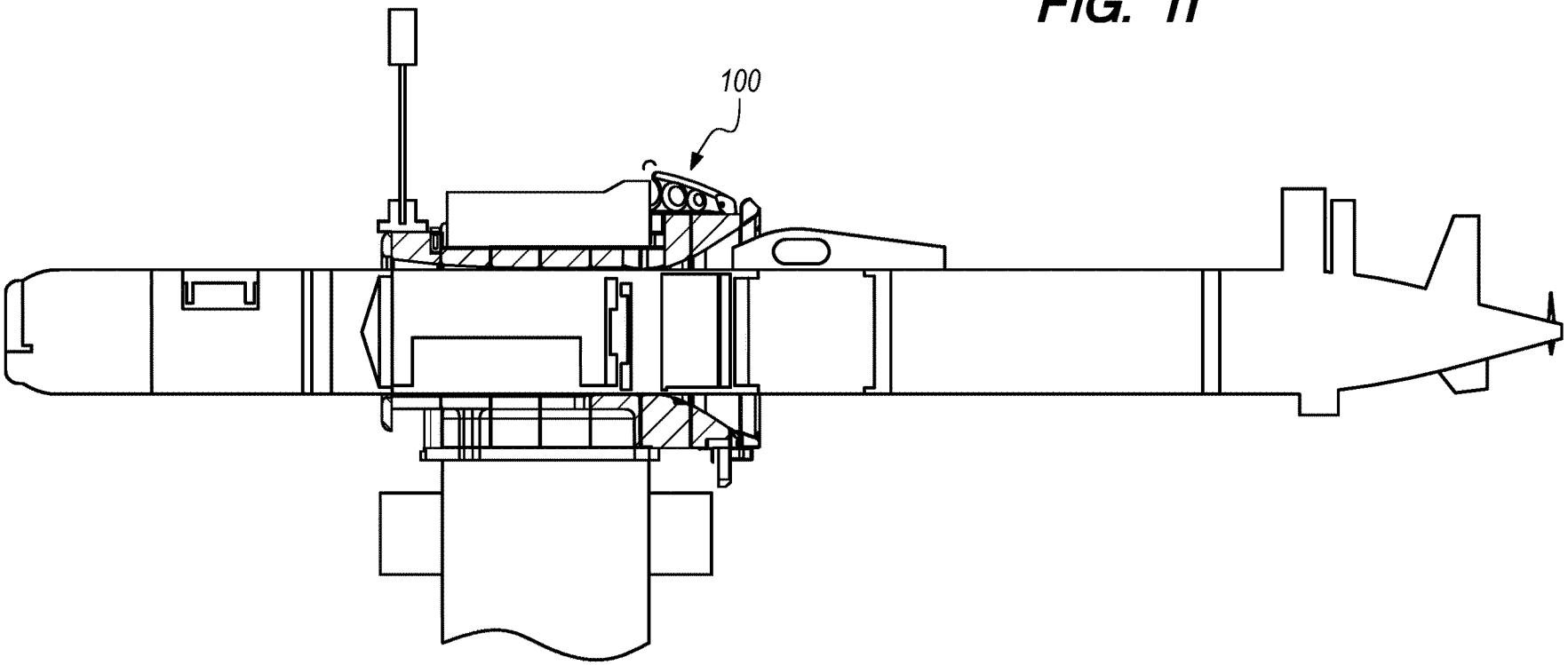
FIG. 11 is a sectional view showing an underwater vehicle docking with an embodiment of the present invention.

FIG. 10 shows a front perspective view of the device 100 with an underwater vehicle docked. FIG. 11 shows a sectional view of the device 100 with an underwater vehicle docked. In this embodiment, when docking, if the vehicle initially does not strike the cap member 201, first bell member 301, or second bell member 401, then the vehicle initially interfaces with the third bell member 501. The vehicle's kinetic energy is absorbed into the third bell member 501, and the gaps between the third bell member 501 and fourth bell member 601, fourth bell member 601 and fifth bell member 701, fifth bell member 701 and sixth bell member 801 decreases, squeezing out the working fluid.

When tuning the dampers 208, the masses of the bell members, and the gap geometry between the bell members, the largest expected impact should just bottom the bell members together. The device 100 should be tuned such that the bell members move as much as they can for lesser impacts.

Once docking is complete (once the vehicle has come to a stop), the device 100 relaxes and the bell members return to their original static and mostly rigid form. This rigidity of the system allows for precise alignment and docking objectives. When docking has been completed, or when it is desired to relaunch the vehicle, the vehicle can be released, swimming through or reversing out. If the vehicle has mating pins, the pins will need to be released. Alternatively, various bell members can neck down to hold the vehicle in place.

Elements of the device 100 can be made from many available materials to meet the needs of the vehicle. While in this embodiment, the bell members were machined from ultra-high-molecular-weight polyethylene and the frame members from aluminum, the various elements can be made from other suitable materials. Similarly, where the dampers 208 in this embodiment were segments of O-ring cord, these dampers 208 could be replaced by springs or other dampers, as well as rubbers of different shapes or other compliant materials. Alternatively, the bell members themselves may be made from compliant materials and act as springs. In this embodiment, a conically shaped first bell hole 302 and second bell hole 402 facilitate guidance for the vehicle if it errs in its angle of approach or if it has translational errors. This shape can be varied and tuned to accommodate different guidance accuracies of the target vehicle.

The present invention achieves at least several improvements over the prior art. To prevent damage to sensitive vehicle electronics, a compliant structure is used. This is beneficial in dissipating the relatively large impact energy of larger vehicles. Additionally, the simple solid materials deform under impact stress. The rigidity of the structure also ensures that vehicles will be correctly captured, oriented, and securely held for the mating of sensitive sensors or communications devices. The lack of external structures which could catch or bind the vehicle ensures that the vehicle is able to reverse out under its own power once the mission is complete.

From the above description of the present invention, it is manifest that various techniques may be used for implementing its concepts without departing from the scope of the claims. The described embodiments are to be considered in all respects as illustrative and not restrictive. The device disclosed herein may be practiced in the absence of any element that is not specifically claimed and/or disclosed herein. It should also be understood that the present invention is not limited to the particular embodiments described herein, but is capable of being practiced in many embodiments without departure from the scope of the claims.

What is claimed is:

1. A device for capturing underwater vehicles comprising:

a cap member connected to a first rib member; a first plate member connected to the first rib member;

a first bell member with a first bell hole formed therethrough; wherein the first bell member has a first receiving hole formed therethrough; wherein the first bell member has a first bell slot formed therethrough;

wherein a damper and a shim are slidably received in the first bell slot; and wherein the first rib member is slidably received in the first bell hole.

2. The device of claim 1 further comprising a second bell member with a second bell hole formed therethrough; wherein the second bell member has a second receiving hole formed therethrough; wherein the second bell member has a second bell slot formed thereon.

3. The device of claim 2 further comprising a third bell member with a third bell hole formed therethrough; wherein the third bell member has a third receiving hole formed therethrough; wherein the third bell member has a third bell slot formed thereon.

4. The device of claim 3 further comprising a fourth bell member with a fourth bell hole formed therethrough; wherein the fourth bell member has a fourth receiving opening formed therethrough; wherein the fourth bell member has a fourth bell slot formed thereon.

5. The device of claim 4 further comprising a fifth bell member with a fifth bell hole formed therethrough; wherein the fifth bell member has a fifth receiving opening formed therethrough; wherein the fifth bell member has a fifth bell slot formed thereon.

6. The device of claim 5 further comprising a sixth bell member with a sixth bell hole formed therethrough; wherein the sixth bell member has a sixth receiving opening formed therethrough; wherein the sixth bell member has a six bell slot formed thereon.

7. The device of claim 6 further comprising a seventh bell member with a seventh bell hole formed therethrough; wherein the seven bell member has a seventh receiving opening formed therethrough.

8. The device of claim 7 wherein a damper and a shim are slidably received in each of the first bell slot, second bell slot, third bell slot, fourth bell slot, fifth bell slot, sixth bell slot.

9. The device of claim 7 wherein the first rib member is slidably received in the first bell hole and second bell hole; wherein the second rib member is slidably received in the third bell hole, the fourth bell hole, the fifth bell hole, the sixth bell hole; wherein the third rib member is slidably received in the seventh bell hole.

10. A device for capturing underwater vehicles comprising:

a cap member connected to a first rib member; a first plate member connected to the first rib member; a second rib member connected to the first plate member; a second plate member connected to the second rib member; a third rib member connected to the second plate member; a tail member connected to the third rib member;

a first bell member with a first bell hole formed therethrough; wherein the first bell member has a first receiving hole formed therethrough; wherein the first bell member has a first bell slot formed thereon;

a second bell member with a second bell hole formed therethrough; wherein the second bell member has a second receiving hole formed therethrough; wherein the second bell member has a second bell slot formed thereon;

a third bell member with a third bell hole formed therethrough; wherein the third bell member has a third receiving hole formed therethrough; wherein the third bell member has a third bell slot formed thereon;

a fourth bell member with a fourth bell hole formed therethrough; wherein the fourth bell member has a fourth receiving opening formed therethrough; wherein the fourth bell member has a fourth bell slot formed thereon;

a fifth bell member with a fifth bell hole formed therethrough; wherein the fifth bell member has a fifth receiving opening formed therethrough; wherein the fifth bell member has a fifth bell slot formed thereon;

a sixth bell member with a sixth bell hole formed therethrough; wherein the sixth bell member has a sixth receiving opening formed therethrough; wherein the sixth bell member has a six bell slot formed thereon;

a seventh bell member with a seventh bell hole formed therethrough; wherein the seven bell member has a seventh receiving opening formed therethrough;

wherein a damper and a shim are slidably received in each of the first bell slot, second bell slot, third bell slot, fourth bell slot, fifth bell slot, sixth bell slot; and wherein the first rib member is slidably received in the first bell hole and second bell hole; wherein the second rib member is slidably received in the third bell hole, the fourth bell hole, the fifth bell hole, the sixth bell hole; wherein the third rib member is slidably received in the seventh bell hole.

11. The device of claim 10 wherein the first rib member is parallel with the second rib member.

12. The device of claim 10 wherein the second rib member is parallel with the third rib member.

13. The device of claim 10 wherein the cap member is parallel with the first plate member.

14. The device of claim 10 wherein the first plate member is parallel with the second plate member.

15. The device of claim 10 wherein the second plate member is parallel with the tail member.

16. A device for capturing underwater vehicles comprising:

a cap member connected to a plurality of first rib members; a first plate member connected to each of the first rib members; a plurality of second rib members connected to the first plate member; a second plate member connected to each of the second rib members; a plurality of third rib members connected to the second plate member; a tail member connected to each of the third rib members;

a first bell member with a plurality of first bell holes formed therethrough; wherein the first bell member has a first receiving hole formed therethrough; wherein the first bell member has a plurality of first bell slots formed thereon;

a second bell member with a plurality of second bell holes formed therethrough; wherein the second bell member has a second receiving hole formed therethrough;

wherein the second bell member has a plurality of second bell slots formed thereon;

a third bell member with a plurality of third bell holes formed therethrough; wherein the third bell member has a third receiving hole formed therethrough; wherein the third bell member has a plurality of third bell slots formed thereon;

a fourth bell member with a plurality of fourth bell holes formed therethrough; wherein the fourth bell member has a fourth receiving opening formed therethrough; wherein the fourth bell member has a plurality of fourth bell slots formed thereon;

a fifth bell member with a plurality of fifth bell holes formed therethrough; wherein the fifth bell member has a fifth receiving opening formed therethrough; wherein the fifth bell member has a plurality of fifth bell slot formed thereon;

a sixth bell member with a plurality of sixth bell holes formed therethrough; wherein the sixth bell member has a sixth receiving opening formed therethrough; wherein the sixth bell member has a plurality of six bell slots formed thereon;

a seventh bell member with a plurality of seventh bell holes formed therethrough; wherein the seven bell member has a seventh receiving opening formed therethrough;

wherein a damper and a shim are slidably received in each of the first bell slots, second bell slots, third bell slots, fourth bell slots, fifth bell slots, sixth bell slots;

wherein the first rib member is slidably received in the first bell hole and second bell hole; wherein the second rib member is slidably received in the third bell hole, the fourth bell hole, the fifth bell hole, the sixth bell hole; wherein the third rib member is slidably received in the seventh bell hole; and wherein each first rib member is parallel with each second rib member; wherein each second rib member is parallel with each third rib member; wherein the cap member is parallel with the first plate member; wherein the first plate member is parallel with the second plate member; wherein the second plate member is parallel with the tail member.

17. The device of claim 16 comprising eight first rib members.

18. The device of claim 16 comprising six second rib members.

19. The device of claim 16 comprising four third rib members.

20. The device of claim 16 wherein the first receiving hole, second receiving hole, third receiving hole, fourth receiving opening, fifth receiving opening, sixth receiving opening, and seventh receiving opening are concentrically formed.

* * * * *